US007272862B1

(12) United States Patent
Ellington

(10) Patent No.: US 7,272,862 B1
(45) Date of Patent: Sep. 25, 2007

(54) PANT CUFF PROTECTING DEVICE AND METHOD

(76) Inventor: Lloyd Ellington, 2 Adam Close Bellingham, London (GB) SE6 2ST ( * ) Notice: Subject to any disclaimer, the term of this patent is extended or adjusted under 35 U.S.C. 154(b) by 0 days.

(21) Appl. No.: 11/261,796

(22) Filed: Oct. 31, 2005

(51) Int. Cl.
*A41D 1/06* (2006.01)

(52) U.S. Cl. ..... 2/232; 24/72.1

(58) Field of Classification Search ..... 2/230, 2/231, 232, 222, 920, 300, 245, 60, 46; 36/8.3, 36/70 B, 70 R; 24/72.1
See application file for complete search history.

(56) References Cited

U.S. PATENT DOCUMENTS

| | | | | | |
|---|---|---|---|---|---|
| 64,161 | A | * | 4/1867 | Smith et al. | 2/232 |
| 176,292 | A | * | 4/1876 | Gardner | 2/232 |
| 257,026 | A | * | 4/1882 | Langan | 2/232 |
| 261,029 | A | * | 7/1882 | Olney | 2/232 |
| 450,809 | A | * | 4/1891 | Hicks | 36/70 R |
| 485,807 | A | * | 11/1892 | Aaronson | 2/232 |
| 639,568 | A | * | 12/1899 | Herald | 24/507 |
| 668,051 | A | * | 2/1901 | Puffer | 36/70 R |
| 719,462 | A | * | 2/1903 | Gysling | 24/559 |
| 763,029 | A | * | 6/1904 | Terzian | 2/232 |
| 898,200 | A | * | 9/1908 | Elzas | 2/232 |
| 955,631 | A | | 4/1910 | Cerri | |
| 1,211,472 | A | * | 9/1917 | Marcell | 2/232 |
| 1,449,060 | A | * | 3/1923 | Sanders | 24/101 B |
| 2,042,567 | A | | 6/1936 | Trioschmann | |
| 2,107,516 | A | * | 2/1938 | Bishop | 24/72.1 |
| D120,887 | S | | 6/1940 | Grezlyk | |
| 2,574,669 | A | | 11/1951 | Snider | |
| 2,729,868 | A | * | 1/1956 | Manning | 24/545 |
| 2,819,469 | A | | 1/1958 | Lyles | |
| 3,099,269 | A | * | 7/1963 | Walter | 24/67.11 |
| 3,950,823 | A | * | 4/1976 | Schreter | 24/66.13 |
| 4,086,686 | A | * | 5/1978 | Takabayashi | 24/504 |
| 4,115,906 | A | * | 9/1978 | Lavine et al. | 24/72.1 |
| D253,977 | S | * | 1/1980 | Mahoney | D11/214 |
| 4,745,665 | A | * | 5/1988 | Hilsenbeck | 24/295 |
| 4,964,176 | A | | 10/1990 | Previdi | |
| 4,991,269 | A | * | 2/1991 | Kuroda | 24/67.11 |
| D363,453 | S | * | 10/1995 | Herdt | D11/78.1 |
| 6,175,965 | B1 | * | 1/2001 | Schoberg | 2/232 |
| 6,253,385 | B1 | * | 7/2001 | Fields | 2/246 |
| 6,618,862 | B1 | * | 9/2003 | Bunjes | 2/232 |
| 7,086,123 | B2 | * | 8/2006 | Carter | 24/72.1 |
| 2005/0199771 | A1 | * | 9/2005 | Simpson | 248/313 |
| 2006/0010661 | A1 | * | 1/2006 | Murphy | 024/545 |
| 2006/0213036 | A1 | * | 9/2006 | Flowers et al. | 024/72.1 |

* cited by examiner

*Primary Examiner*—Alissa Hoey
*Assistant Examiner*—Jena A Sold

(57) ABSTRACT

A pant cuff protecting device includes a clip member that has a central section and a first leg and a second leg each attached to and extending away from the central section so that the clip member is U-shaped. Each of the first and second legs has an inner surface facing each other and an outer surface facing away from each other. The central member biases the first and second legs toward each other. The clip member is positioned on a pant cuff such that the cuff is adjacent to and extends along the central member and such that the first leg is positioned outside of a pant leg of the pant cuff.

11 Claims, 2 Drawing Sheets

FIG. 2
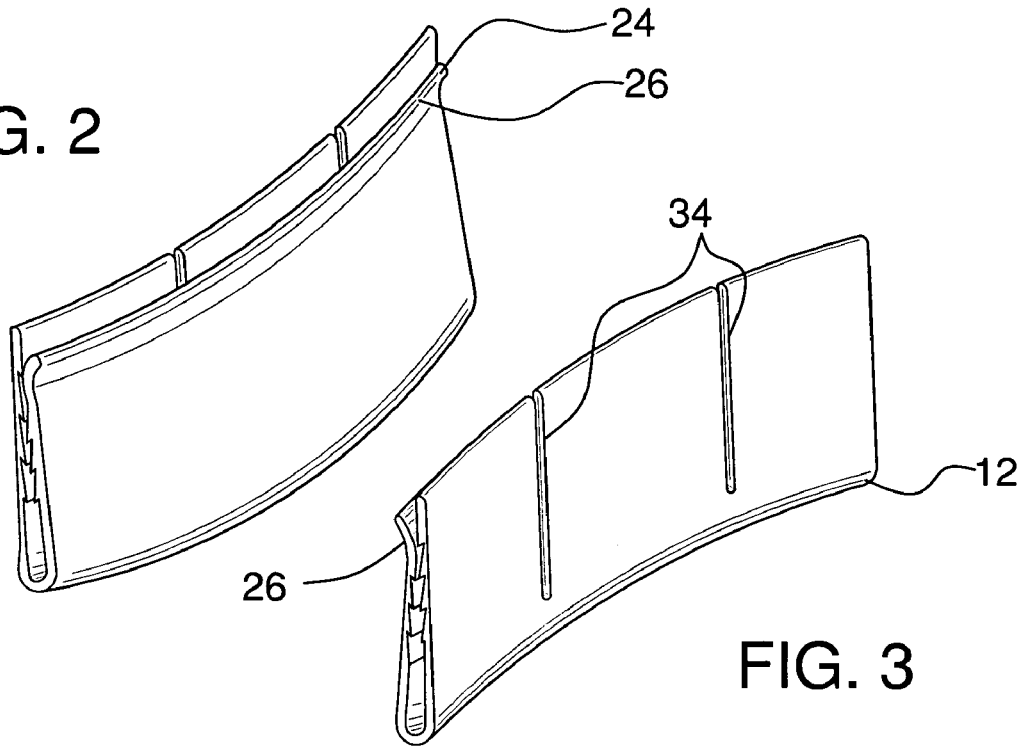
FIG. 3
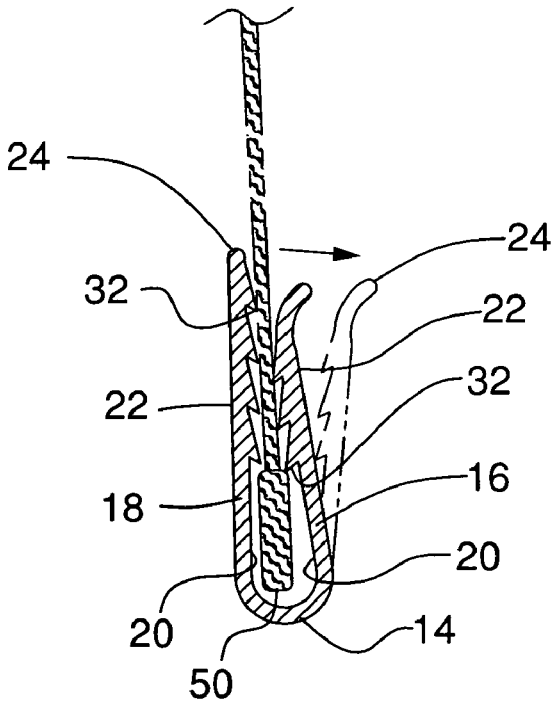
FIG. 4

PANT CUFF PROTECTING DEVICE AND METHOD

BACKGROUND OF THE INVENTION

1. Field of the Invention

The present invention relates to cuff protecting devices and more particularly pertains to a new cuff protecting device for protecting a pant cuff from abrasions against a ground surface.

2. Description of the Prior Art

The use of cuff protecting devices is known in the prior art. U.S. Pat. No. 176,292 describes a device for protecting the bottom portion of a pant leg. Another type of cuff protecting device is U.S. Pat. No. 2,819,469 which includes a device having a structure particularly well suited for protecting an edge of a shirt cuff. Yet another such device is found in U.S. Pat. No. 2,574,669.

While these devices fulfill their respective, particular objectives and requirements, the need remains for a device that is well adapted for protecting a pant leg cuff. The device should include gripping elements to ensure that the device is firmly secured to the pant leg cuff. The device will prevent abrasions to the cuff from a ground surface.

SUMMARY OF THE INVENTION

The present invention meets the needs presented above by generally comprising a clip member that includes a central section and a first leg and a second leg each attached to and extending away from the central section so that the clip member is U-shaped. Each of the first and second legs has an inner surface facing each other and an outer surface facing away from each other. The first and second legs are biased toward each other by the central member. The clip member is positioned on a pant cuff such that the cuff is adjacent to and extends along the central member and such that the first leg is positioned outside of a pant leg of the pant cuff.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective front view of the present invention.

FIG. 3 is a perspective rear view of the present invention.

FIG. 4 is a cross-sectional view taken along line 4-4 of FIG. 1 of the present invention.

DESCRIPTION OF THE PREFERRED EMBODIMENT

Figure 1:
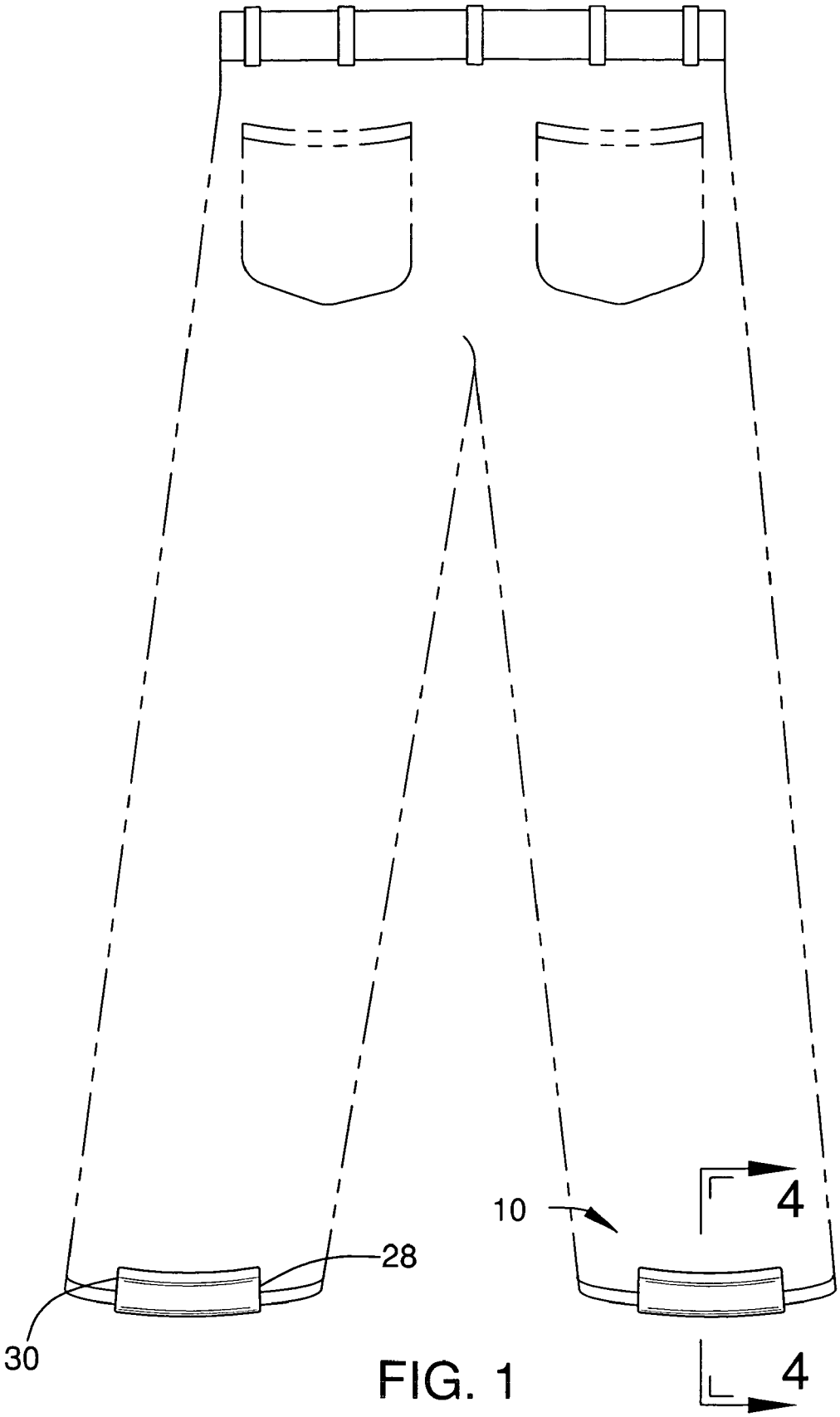
FIG. 1 is a front in-use view of a pant cuff protecting device and method according to the present invention.

With reference now to the drawings, and in particular to FIGS. 1 through 4 thereof, a new cuff protecting device embodying the principles and concepts of the present invention and generally designated by the reference numeral 10 will be described.

As best illustrated in FIGS. 1 through 4, the pant cuff protecting device and method 10 generally comprises a clip member 12 that includes a central section 14 and a first leg 16 and a second leg 18 each attached to and extending away from the central section 14. The clip member 12 is generally U-shaped. Each of the first 16 and second 18 legs has an inner surface 20 facing each other and an outer surface 22 facing away from each other. The central member 14 is comprised of a resiliently flexible material, such a plastic, which biases the first 16 and second 18 legs toward each other. The first 16 and second 18 legs each have an upper edge 24. The first leg 16 has a bend 26 therein positioned adjacent to the upper edge of the first leg 16 so that the upper edge 24 of the first leg 16 is angled away from the second leg 18.

Each of the legs 16, 18 has a first outer edge 28 and a second outer edge 30. The outer surface 22 of the first leg 16 is convex from the first outer edge 28 to the second outer edge 30. The outer surface 22 of the second leg 18 is concave from the first outer edge 28 to the second outer edge 30 so that the clip member 12 is arcuate from the first outer edge 28 to the second outer edge 30. Each of the inner surfaces 20 of the first 16 and second 18 legs has a plurality of gripping members 32 integrally attached thereto. The gripping members 32 comprise downwardly extending teeth. The second leg 18 has a plurality of slits 34 therein. The slits 34 each extend from the central member 14 and through the upper edge 24 of the second leg 18. Each the first 16 and second 18 legs has a height generally between 1 inch and 3 inches and each of the first 16 and second 18 legs has a length from the first outer edge 28 to the second outer edge 30 generally between 2 inches and 6 inches. The central member 14 has a rounded bottom surface.

In use, the clip member 12 is positioned on a pant cuff 50 so that the cuff 50 is adjacent to and extends along the central member 14 and so that the first leg 16 is positioned outside of a pant leg of the pant cuff 50. The clip 12 is located on the back of the pant leg where the pant leg often hangs down past the heel. The clip member 12 will prevent the cuff 50 from contacting the ground and thereby prevent damage to the cuff 50. The bend 26 aids a person in pulling the first leg 16 away from the second leg 18.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of protecting a pant cuff comprising the steps of:

providing a clip member including a central section and a first leg and a second leg each being attached to and extending away from said central section such that said clip member is generally U-shaped, each of said first and second legs having an inner surface facing each other and an outer surface facing away from each other, said first and second legs being biased toward each other by said central member, each of said inner surfaces of said first and second legs have a plurality of gripping members integrally attached thereto, each of said gripping members comprises downwardly extending teeth, said teeth being positioned in vertically aligned rows of teeth, said rows including at least three rows of teeth being positioned on each of said first and second legs, each of said first and second legs has an upper edge, said second leg having a plurality of slits therein extending from said central member through said upper edge of said second leg;

positioning said clip member on a pant cuff such that said cuff is adjacent to and extends along said central member and such that said first leg is positioned outside of a pant leg of the pant cuff.

2. The method according to claim 1, wherein each of said first and second legs having an upper edge, said first leg having a bend therein positioned adjacent to said upper edge such that said upper edge of said first leg is angled away from said second leg.

3. The method according to claim 1, wherein each of said legs having a first outer edge and a second outer edge, said outer surface of said first leg being convex from said first outer edge to said second outer edge and said outer surface of second leg being concave from said first outer edge to said second outer edge such that said clip member is arcuate.

4. The method according to claim 3, wherein each said first and second legs having a height generally between 1 inch and 3 inches, each of said first and second legs having a length from said first outer edge to said second outer edge generally between 2 inches and 6 inches.

5. The method according to claim 4, wherein said central member has a rounded bottom surface.

6. A method of protecting a pant cuff comprising the steps of:

providing a clip member including a central section and a first leg and a second leg each being attached to and extending away from said central section such that said clip member is generally U-shaped, each of said first and second legs having an inner surface facing each other and an outer surface facing away from each other, said first and second legs being biased toward each other by said central member, each of said first and second legs having an upper edge, said first leg having a bend therein positioned adjacent to said upper edge such that said upper edge of said first leg is angled away from said second leg, each of said legs having a first outer edge and a second outer edge, said outer surface of first leg being convex from said first outer edge to said second outer edge and said outer surface of second leg being concave from said first outer edge to said second outer edge such that said clip member is arcuate, each of said inner surfaces of said first and second legs having a plurality of gripping members integrally attached thereto, said gripping members comprising downwardly extending teeth, said second leg having a plurality of slits therein extending from said central member through said upper edge of said second leg, each said first and second legs having a height generally between 1 inch and 3 inches, each of said first and second legs having a length from said first outer edge to said second outer edge generally between 2 inches and 6 inches, said central member having a rounded bottom surface;

positioning said clip member on a pant cuff such that said cuff is adjacent to and extends along said central member and such that said first leg is positioned outside of a pant leg of the pant cuff.

7. A method of protecting a pant cuff comprising the steps of:

providing a clip member including a central section and a first leg and a second leg each being attached to and extending away from said central section such that said clip member is generally U-shaped, each of said first and second legs having an inner surface facing each other and an outer surface facing away from each other, said first and second legs being biased toward each other by said central member, each of said first and second legs has an upper edge, said second leg having a plurality of slits therein extending from said central member through said upper edge of said second leg, each of said gripping members comprises downwardly extending teeth;

positioning said clip member on a pant cuff such that said cuff is adjacent to and extends along said central member and such that said first leg is positioned outside of a pant leg of the pant cuff.

8. The method according to claim 7, wherein said first leg having a bend therein positioned adjacent to said upper edge such that said upper edge of said first leg is angled away from said second leg.

9. The method according to claim 7, wherein each of said legs having a first outer edge and a second outer edge, said outer surface of said first leg being convex from said first outer edge to said second outer edge and said outer surface of second leg being concave from said first outer edge to said second outer edge such that said clip member is arcuate.

10. The method according to claim 7, wherein each of said inner surfaces of said first and second legs have a plurality of gripping members integrally attached thereto.

11. The method according to claim 7, wherein said central member has a rounded bottom surface.

* * * * *